US005918445A

United States Patent [19]

Tisma et al.

[11] Patent Number: 5,918,445

[45] Date of Patent: Jul. 6, 1999

[54] AUTOMATIC PACKAGING MACHINE FOR INSERTING A FEW SMALL ITEMS WITH DESIRED ORIENTATION INTO A CARTON

[75] Inventors: Stevan Tisma, c/o 1099 Estes Ave., Elk Grove Village, Ill. 60007; Walter H. Vogel, Hoffman Estates, Ill.

[73] Assignee: Stevan Tisma, Elk Grove Village, Ill.

[21] Appl. No.: 08/856,443

[22] Filed: May 14, 1997

Related U.S. Application Data

[60] Provisional application No. 60/018,296, May 24, 1996, and provisional application No. 60/017,757, May 16, 1996, Pat. No. 8,848,127.

[51] Int. Cl.[6] ..... B65B 35/56

[52] U.S. Cl. ..... 53/544; 53/534; 53/154; 53/155; 53/247; 53/237; 53/238; 53/251; 53/255

[58] Field of Search ..... 53/154, 155, 237, 53/238, 247, 255, 258, 260, 250, 251, 252, 566, 533, 534, 543, 544

[56] References Cited

U.S. PATENT DOCUMENTS

| | | | |
|---|---|---|---|
| 3,339,335 | 9/1967 | Bowden | 53/237 X |
| 3,994,321 | 11/1976 | Eisenberg | 53/237 X |
| 4,094,129 | 6/1978 | List | 53/493 X |
| 4,211,055 | 7/1980 | Long et al. | 53/252 X |
| 4,248,027 | 2/1981 | Cleary et al. | 53/251 X |
| 4,265,072 | 5/1981 | Egli | 53/544 X |
| 4,646,509 | 3/1987 | Tribert | 53/544 X |
| 4,674,259 | 6/1987 | Hills | 53/247 X |
| 5,121,591 | 6/1992 | Backus et al. | 53/263 X |

*Primary Examiner*—Daniel B. Moon
*Attorney, Agent, or Firm*—Laff, Whitesel, Conte & Saret, Ltd.

[57] ABSTRACT

An automatic packaging machine includes a first conveyor which carries a batch of small items along a path extending in a first direction. A second conveyor carries boxes in a second direction which is perpendicular to the first direction. A depositing structure in the form of a twisted funnel rotates the products from the first direction to the second direction before inserting them into a box. An oscillating plate carrying the funnel moves back and forth to fill the box while traveling in a first half of back and forth motion. Then, in the second half of that motion, returns to fill the next box. The oscillating plate may carry a plurality of funnels on each of its opposite sides. A memory of the type of small item carried by each funnel enables a single box to be loaded with different products.

20 Claims, 6 Drawing Sheets

AUTOMATIC PACKAGING MACHINE FOR INSERTING A FEW SMALL ITEMS WITH DESIRED ORIENTATION INTO A CARTON

Reference is made to U.S. provisional application Ser. No. 60/018,296, filed May 24, 1996, which, in turn, was a continuation-in-part of provisional application Ser. No. 60/017,757, filed May 16, 1996, now U.S. patent application Ser. No. 08/848,127 These applications show and describe an automatic packaging machine for inserting a relative large number of small items in a carton with a desired orientation.

This invention relates to automatic packaging machines and more particularly to machines for placing a few small items inside a container, with the small items arranged in a desired orientation therein.

BACKGROUND

Candy coated chewing gum (such as that sold under the trademark "CHICLETS") is an example of small items which are packaged by the inventive machine. For convenience of expression, these and similar items are hereinafter called "small items."

One characteristic of these small items is that they should be laid out in an orderly, side-by-side orientation within a box or other container. Each and every box must contain exactly the correct number of items. They should be treated gently because they may be damaged, if handled roughly. For example, when the small items are Chiclets, the candy coating is likely to break. Finally, as the small items are handled by the packaging machines on the way to the carton, little bits and debris (such as the broken candy coating) tend to accompany the small items. These debris should be sifted out of the product stream so that only whole and unbroken small items are packaged.

Another problem is that traditional packaging machines push the product into the box or other container. If the small items of the described type are so pushed, they tend to lose their orientation so that those in the front may become disoriented causing those behind to pile up and jam or break.

Still other problems will occur to those skilled in the art.

SUMMARY

Accordingly, an object of this invention is to overcome these and similar problems.

In keeping with an aspect of this invention, the input to the packaging machine is a funnel-like hopper which receives the small items from any suitable source. Then, the small items are deposited on a pair of screens which sorts out the small items and discards them as accompanying debris. Next, the screens sort out the small items and discards any larger items, such as when the two or more of the small items are stuck to each other. A conveyor formed by plates having a few (here two by way of example) pockets collects the small items in batches and in a desired orientation. From there, the packaging machine drops the small items into twisted oscillating funnels having a top orientation corresponding to the orientation of the pockets and a bottom orientation corresponding to a carton. Hence, the twist further orients the small items before they are deposited in a carton.

A special feature of the invention is that the funnels move over and in synchronism with the cartons so that the small items may fall freely, finding their own way into their cartons. Then the funnels move back to their starting point in order to load the next set of cartons.

BRIEF DESCRIPTION OF THE DRAWINGS

The invention will be better understood from the following specification taken with the attached drawings, in which.

DETAILED DESCRIPTION

Figure 1:
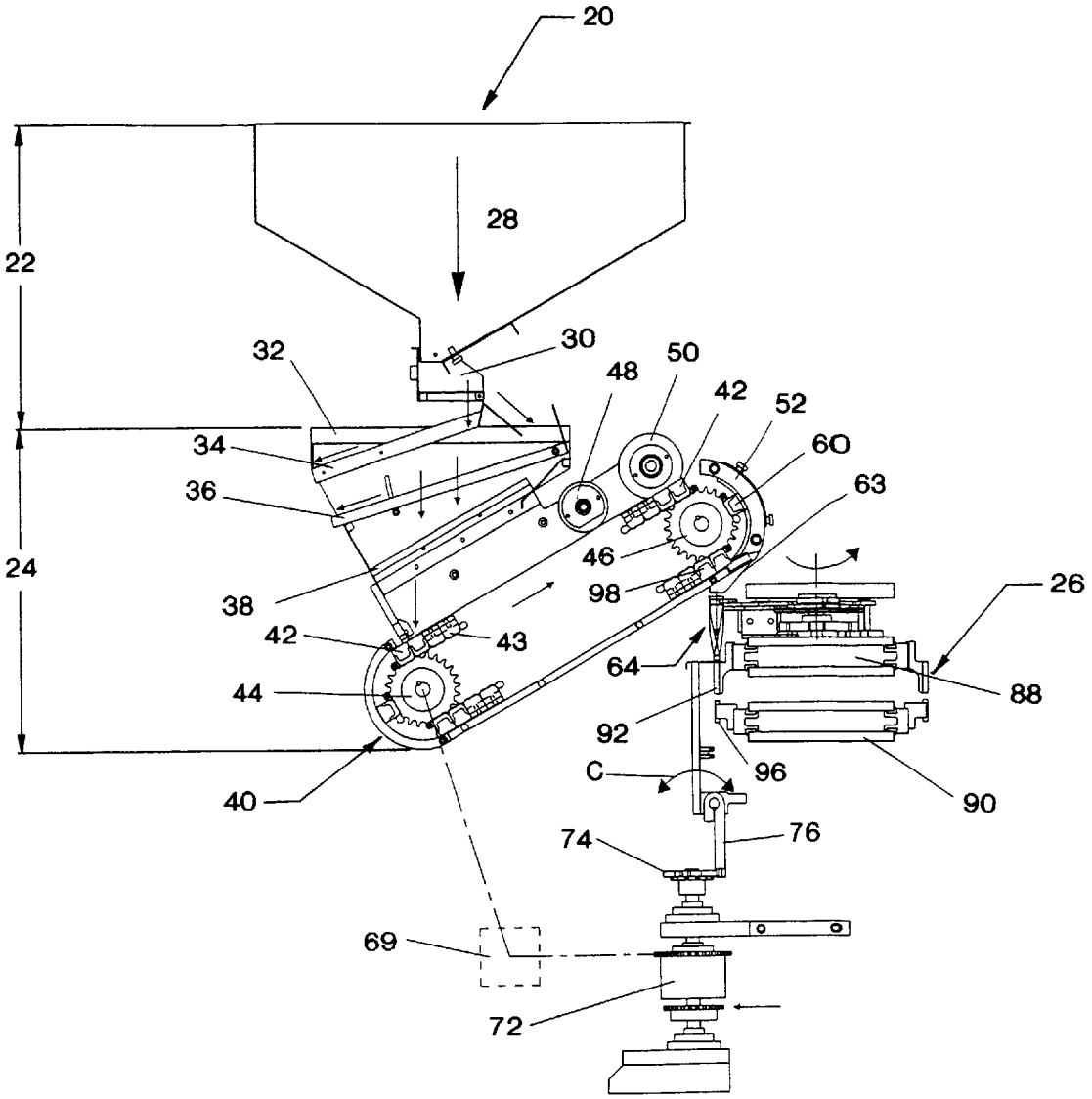
FIG. 1 is a side elevation view of the inventive packaging machine.
Figure 2:
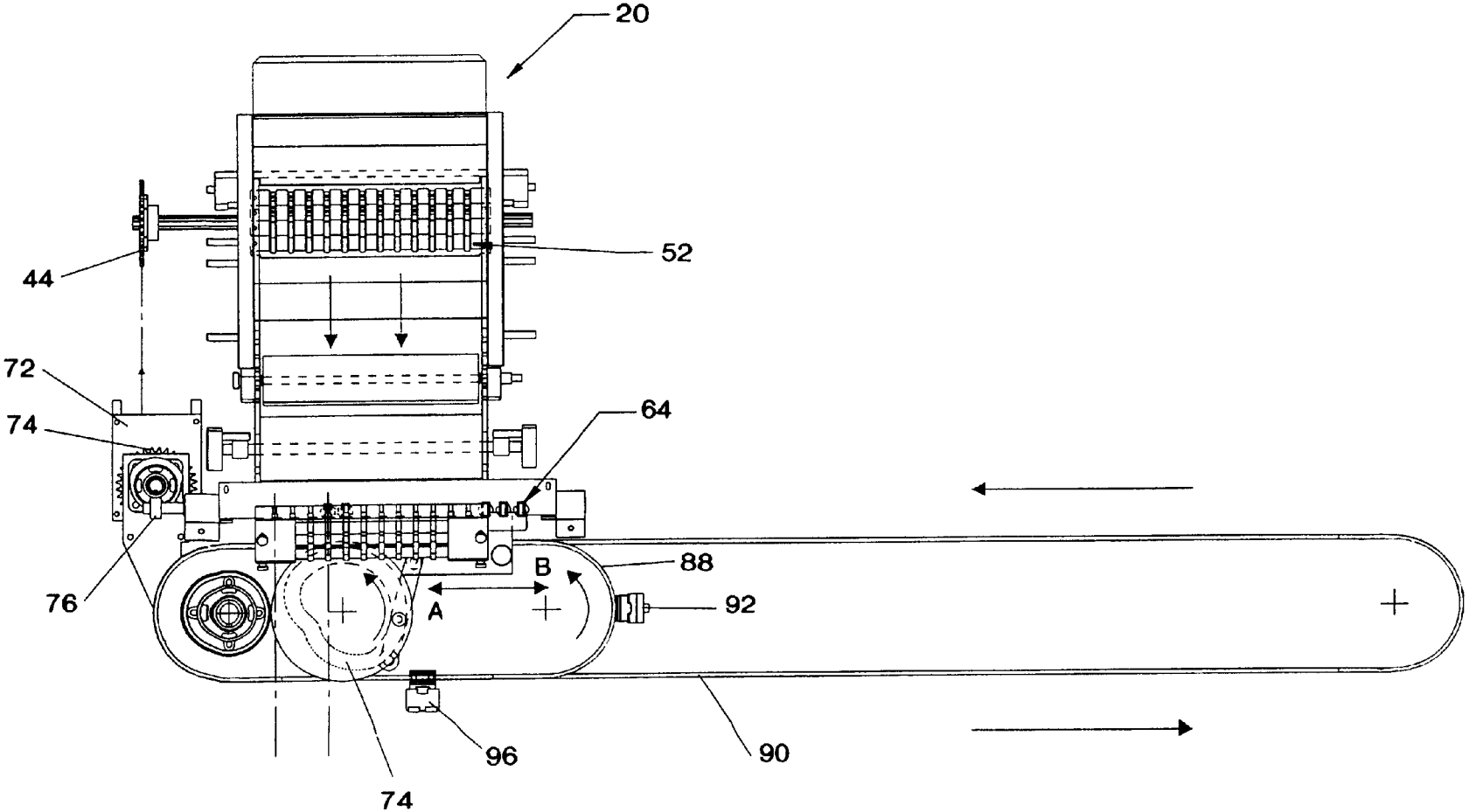
FIG. 2 is a front elevation view of the inventive packaging machine.

FIGS. 1 and 2 show the inventive packaging machine 20 having the major divisions of a product loader section 22, an orientation section 24, and a carton loading section 26. The machine 20 contains small items which have been dumped into a hopper 28, from which they fall under gravity into the orientation section 24 where they are sorted for size and assembled into batches. Then, the batch is loaded into individual cartons in section 26.

In greater detail, the hopper 28 is basically a funnel with a gate 30 under its spout for dropping the small items in an orderly manner onto screen 32 which is adapted to separate all small items from smaller debris. For example, the screen 32 passes broken bits of candy coating and other debris while retaining all undamaged and small and larger items. The debris falls onto tray 34 which carries them away toward the left as viewed in FIG. 1.

The good and larger items remaining on screen tray 32 slide onto a second screen tray 36 which sorts out large items. The good small items fall through the screen tray 36 while the items which are too large are left behind. An example of a too large item is two or more Chiclets which are stuck together. Those large items fall off the left-hand end of tray 36.

The small items which fall through screen 36 and onto tray 38 are the correct size, thereby indicating their acceptability.

Located below the tray 38, a conveyor 40 picks up batches of the small items. In greater detail, a number of pocket plates 42 are attached to a link chain loop 43 trained around sprocket wheels 44 and 46, to form a continuous train of contiguous pocket plates. In the example of a Chiclets box having two pieces per box, each of the 42 plates has two pockets which pick up such pieces in batches of two.

The conveyor 40 is inclined upwardly so that debris will tend to fall off the left-hand end of the conveyor. As the link chain 43 carries pocket plates 42 to the upper end of the conveyor 40, they pass under two brushes 48, 50 extending transversely across the entire width of the surface of the packet plates. These branches sweep any small items into any empty pockets and sweep away everything which is not in the pockets.

Figure 5:
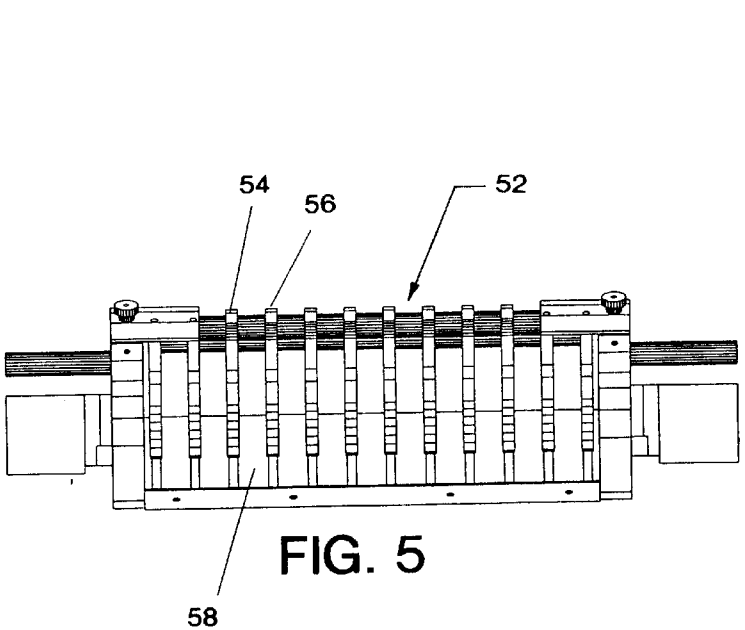
FIG. 5 is a front elevation view taken along line 5—5 of FIG. 3.
Figure 3:
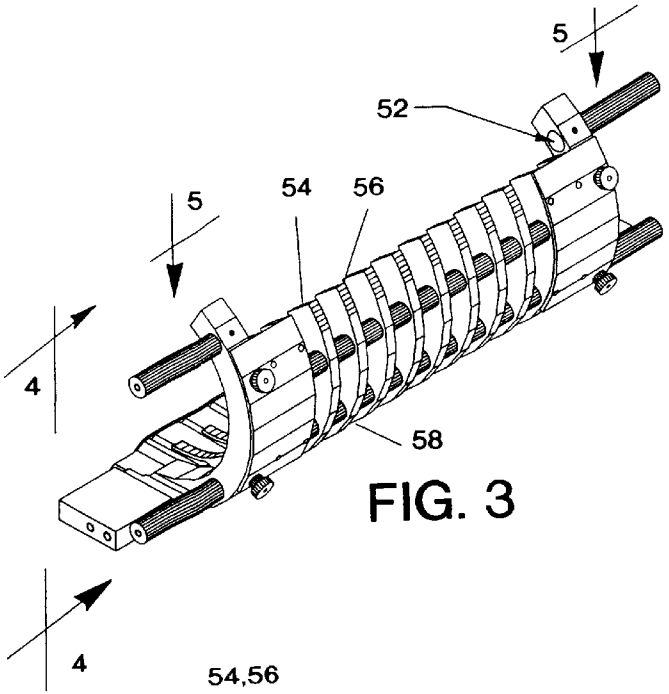
FIG. 3 is a perspective view of a small item inverter.
Figure 10:
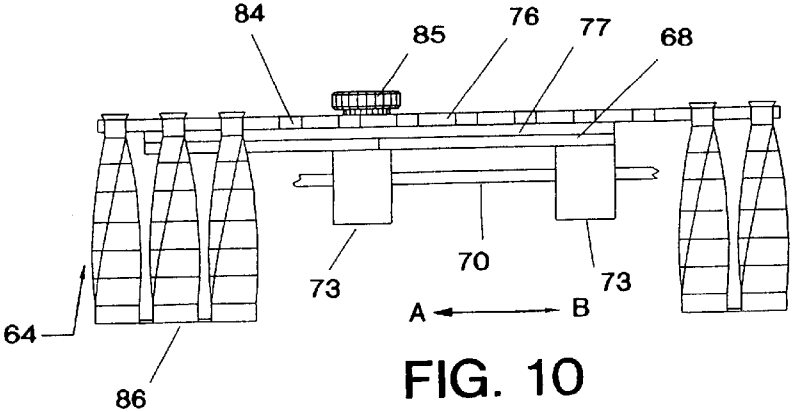
FIG. 10 is a front elevation taken along line 10—10 of FIG. 7.
Figure 4:
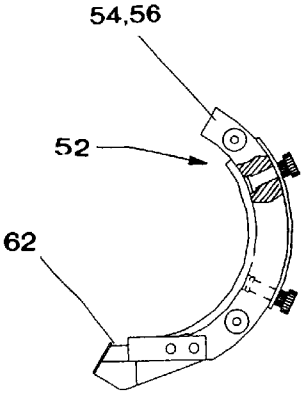
FIG. 4 is an end elevation, taken along line 4—4 of FIG. 3.
Figure 6:
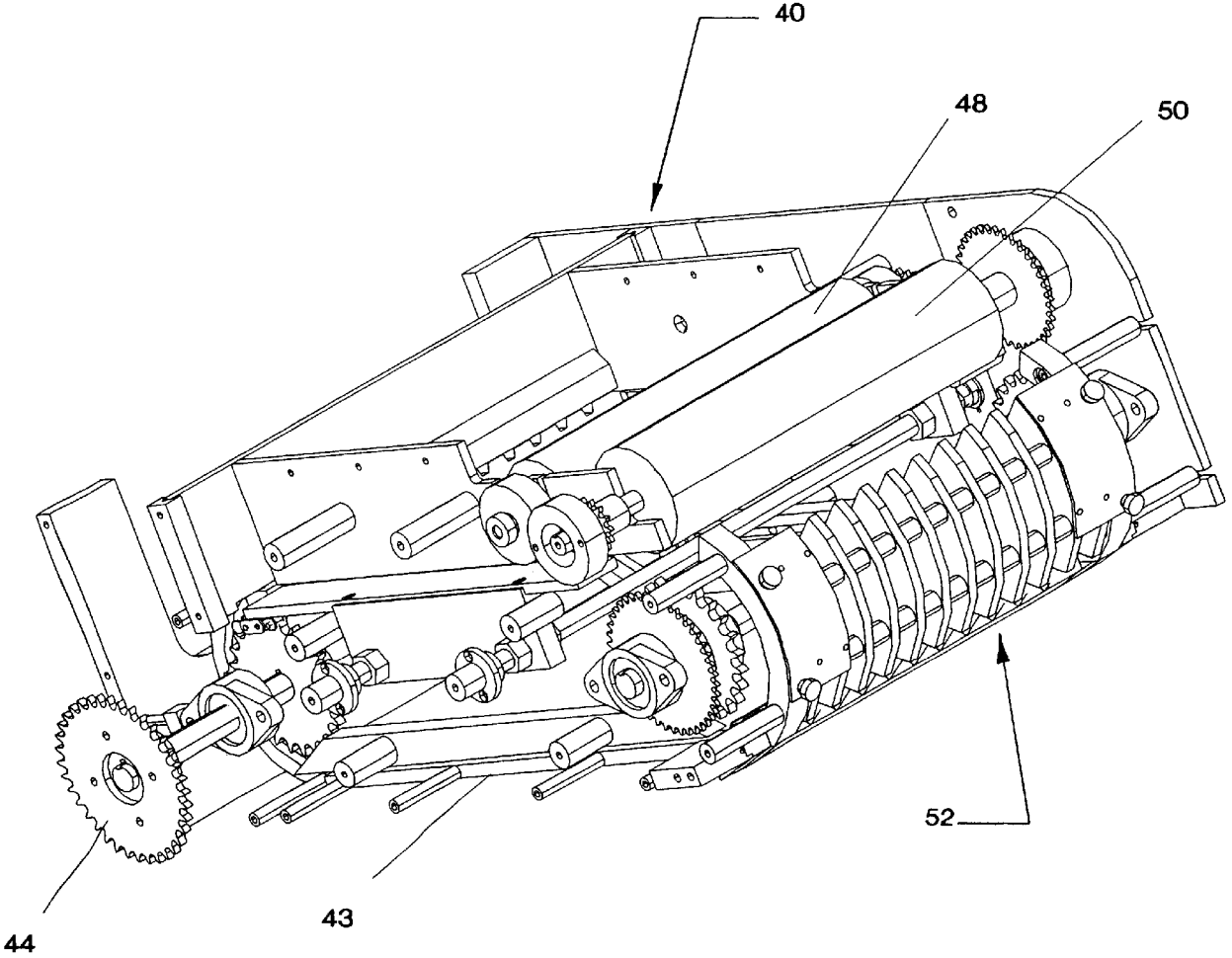
FIG. 6 is a perspective view of an assembled small item orientation machine using parts shown in FIGS. 7–10.
Figure 7:
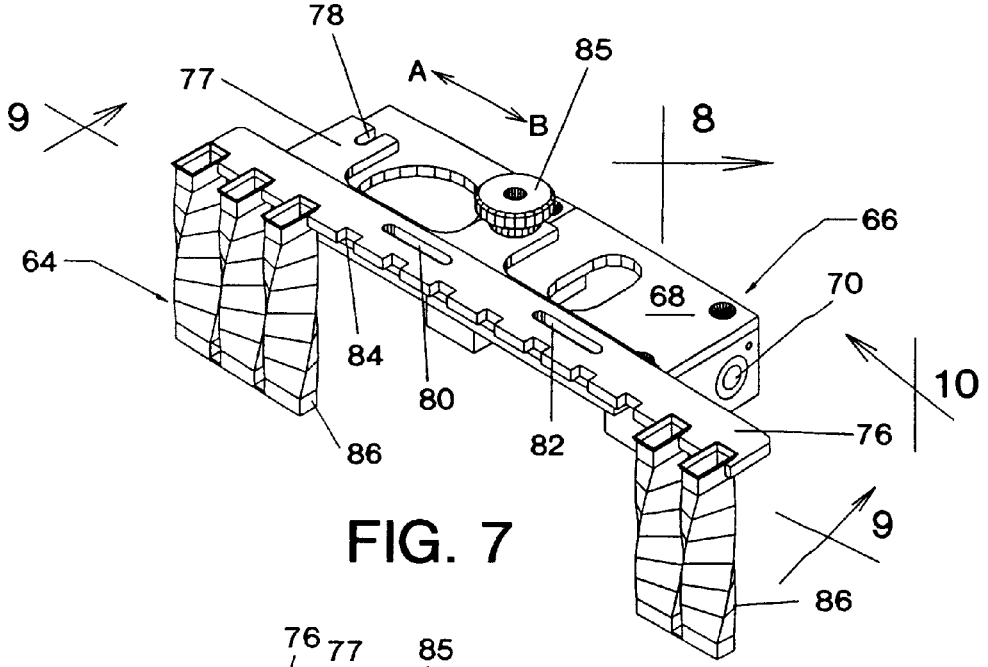
FIG. 7 is a perspective view of an oscillating twisted funnel feeder assembly.
Figure 8:
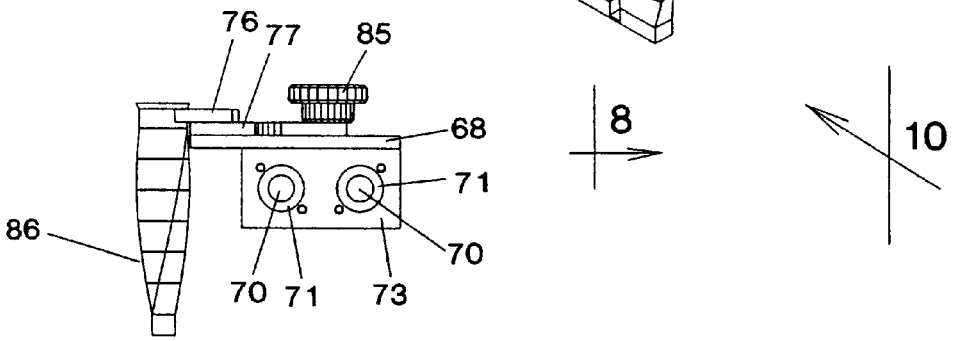
FIG. 8 is a side elevation view taken along the plane 8—8 of FIG. 7.

At the top of the conveyor incline, the pocket plates encounter an inverter 52 shown in detail in FIGS. 3–4. The inverter 52 is formed by a number of spaced parallel plates, such as 54, 46 (FIGS. 3, 4). The plates are close enough to form a space 58 (FIG. 5) which is too narrow to pass any small items that are correctly oriented and lodged in the pockets of plate 42 (FIG. 1), but which is wide enough to pass debris laying on conveyor 43, and perhaps to pass any small items which are not correctly oriented in a pocket.

As best seen in FIG. 4, these spaced plates 54, 56 form a concave surface which is spaced closely enough to the conveyor 43 to keep the small items in the pocket plates 42 while they are inverted. By way of example, a single pocket plate 60 on conveyor 43, is shown in FIG. 1 passing through the concavity of inverter 52. All of the pocket plates 42 forming conveyor 43 travel past inverter 52 in a similar manner. After they emerge from the inverter 52, the pocket plates such as 42, 60 are inverted so that any remaining debris falls away while the small items continue to be held in place by a floor plate 62 (FIG. 3).

As each pocket plate 42 emerges from the floor plate 62, it is at a transfer position chute 63 when it is passing over the mouth of a twisted funnel 64 as shown in FIGS. 7–10. In greater detail, a supporting structure includes an oscillating platform 68 mounted on a pair of stationary rods 70 (FIGS. 10) passing through a slide bearing 71 in blocks 73, 73 (FIG. 8) so that platform 68 may move reciprocally in directions A and B, under the urging of motor 72 (FIG. 1), which also drives sprocket wheel 44 via a gear box 69. Motor 72 drives a cam 74 (FIG. 2) which rotates to swing an arm 76 over an arc as indicated in FIG. 1 by a double-ended arrow C (see also FIG. 2).

Orientation or receiving means in the form of a plurality of twisted funnels 64 mounted on a support plate 76 are connected in selected positions on an adjustment plate 77 in order to deposit small items into a carton or box. The twisted funnels 64 leave one batch of small items in each carton before the end of its stroke in direction A. Then, they return in direction B to receive the next batch of small items.

More particularly, support plate 76 includes an adjustment in an X direction, as indicated by slots 80, 82 (FIG. 9) which provides movement with the range limited by the posts 79, 81. An adjustment plate 77 provides for movement in a Y direction as indicated by slot 78 and post 83. Another such slot is under knob 85 and is not visible in the figures. The adjustment is selected to assure a deposit of the small items received from the pocket plates into an individually associated twisted funnel. When plate 76 is in the selected position on platform 68, the knob 85 is tightened to lock it into position.

The support plate 76 has any suitable number (here twelve) of notches along its front edge, one of which is numbered 84. A twisted funnel (such as 86) is fitted into and supported by each of these notches. This provides a total of twelve lanes, each lane loading a batch of small items into a single carton. This means that twenty-four small items may be simultaneously loaded two to a box.

The small items which are loaded into a carton are rotated in their orientation by 90° while they fall through the twisted funnel. This rotation occurs because conveyor 43 (FIG. 1) carrying the pocket plates 42, 60 travel in a first direction in order to transport the small items in a first orientation. The conveyors 88, 90, which carry the cartons and their loading spouts travel in a second direction which is displaced from the first direction by 90°. The two conveyors 88, 90 are positioned under the twisted funnels 64. Conveyor 88 carries a plurality product spouts 92 mounted at periodic intervals on a link chain 94. Conveyor 90 carries a plurality of cartons 96, each carton being aligned with is individually associated product spout 92 during its travel through the loading station. The conveyors carrying the product spout 92 and the carton 96 move continuously in alignment, and in synchronism.

Figure 11:
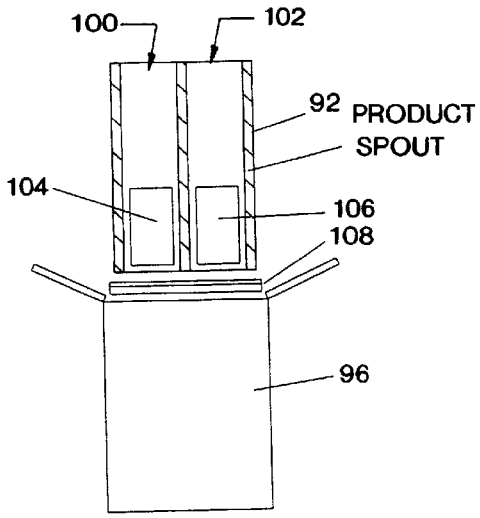
FIG. 11 shows two tracks in a product spout positioned over a carton.

Each of the product spouts 92 (FIG. 11) contain two tracks or slots 100, 102, for example. As the small items fall through the twisted funnels 64, one small item falls into each of the tracks or slots so that two (in this example) small items 104, 106 fall into each carton 96 which is carried by conveyor 90. If desired, any suitable gate 108 may control the delivery of two small items. However, the gate is not necessary if the movement of the conveyors and twisted funnel motion are properly synchronized. Suitable sensors may be provided to confirm the accurate deposit of the prescribed number of small items into each carton.

The reason for the oscillation of the twisted funnel support plate 76 in directions A, B, is to hold the funnel over the product spout as it moves during the loading process. Hence, a batch (here two) of the small items are dropped from a pocket plate 98, through product spout 92, and into carton 96 as the conveyors 88, 90 and the twisted funnels 64 move simultaneously. After the small items drop from the pocket plate, the twisted funnels move back in direction B where they align themselves over the next cartons to be filled.

Figure 9:
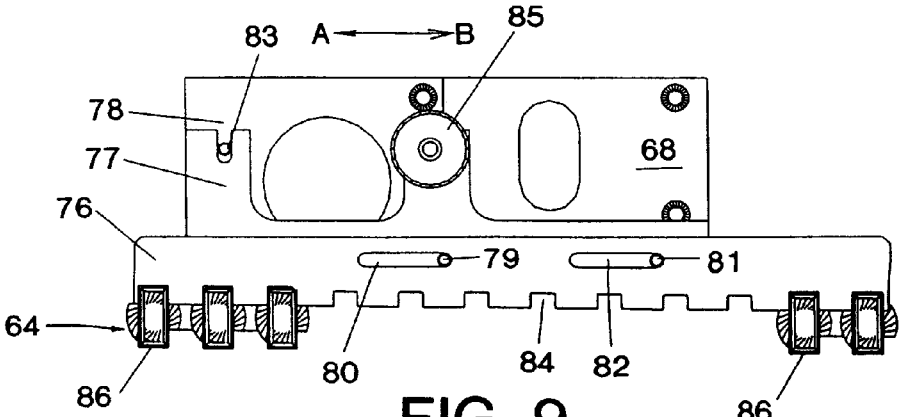
FIG. 9 is a top plan view taken along plane 9—9 of FIG. 7.
Figure 9A:
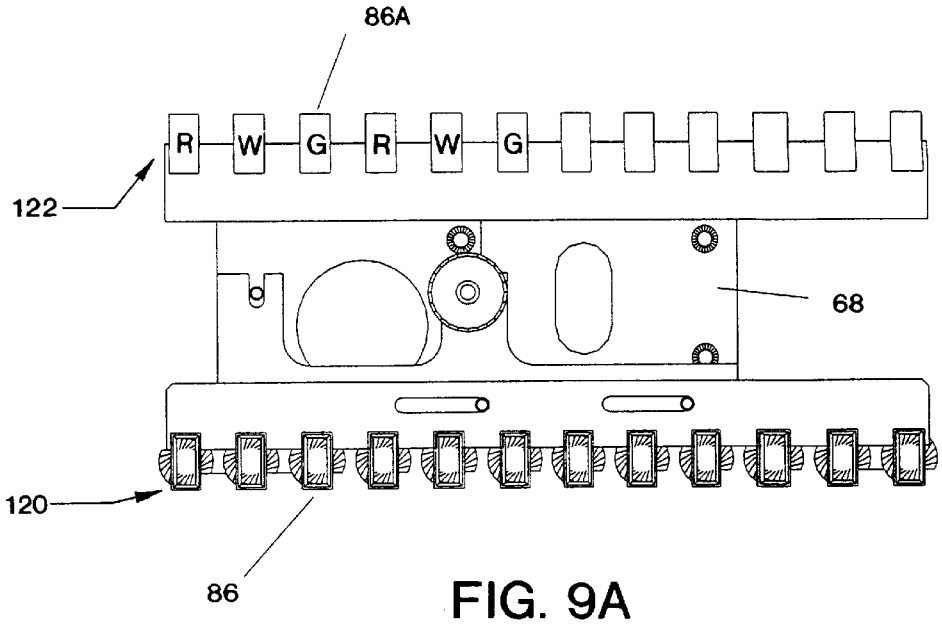
FIG. 9A is a top plan view which is similar to FIG. 9 except there are two oscillating funnel feeder assembly to double the packing speed with almost no added cost in the feeder system.

FIG. 9A shows two sets of funnels 120, 122 mounted on opposite sides of the oscillating platform 68. Hence, the loading speed is doubled because funnel 86, for example, is loading cartons on one side of the platform while funnel 86A is loading cartons on the opposite side of the carton. The funnels 122 are drawn without the twist since that twist is a feature which may or may not be necessary, depending upon the nature of the small item.

Figure 12:
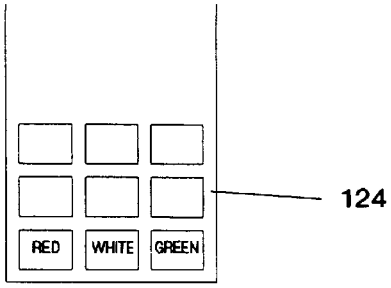
FIG. 12 schematically shows a box loaded with a plurality of types of small items.

Since each funnel travels over a carton while it is being loaded, it is possible to perform some unique packaging features. For example, a microprocessor can "remember" the nature of a small item loaded into each funnel. Here, by way of example, red "Chiclets" may be cinnamon, white may be mint, and green may be spearmint. Hence, FIG. 12 shows a single carton 124 may have three rows of different small items, as shown by the words "red," "white," and "green." My U.S. Pat. No. 4,982,556 shows a method of loading the red, white, and green items into their respective funnels.

Once the small items are in the carton, it is sealed and carried away in a conventional manner.

The foregoing description is for purposes of illustration only and is not intended to limit the scope of protection accorded this invention. The scope of protection is to be measured by the following claims, which should be interpreted to cover all equivalent structures and as broadly as the inventive contribution permits.

The claimed invention is:

1. An automatic packaging machine for batch packaging a few small items, said machine comprising:

a source of small items, loading means extending in a first direction for picking up a batch of said small items from said source and moving them to and releasing them at a transfer position;

conveyor means extending in a second direction at said transfer position for receiving said released small items and loading said small items into cartons carried by said conveyor means; and means for receiving said small items from said loading means in an orientation in which they will appear when in a carton.

2. The automatic packaging machine of claim 1 in which said means for receiving said small items is a twisted funnel which receives said small items in an orientation associated with said first direction to an orientation associated with said second direction, said rotation of said small items occurring between said release by said loading means and said receiving of said small items by said cartons.

3. The automatic packaging machine of claim 1 further comprising synchronizing means for moving said receiving means in synchronism with said loading means and conveyor means.

4. The automatic packaging machine of claim 3 wherein said synchronizing means comprises an oscillating support means holding and reciprocally moving said receiving means over a fixed excursion, at one end of said excursion said receiving means being placed over an empty carton carried by said conveyor means and at an opposite end said excursion said receiving means being returned to said one end of said excursion, said batch of small items moving from said receiving means into said carton during said excursion.

5. The automatic packaging machine of claim 4 wherein said oscillating support means has two sides, and a plurality of said receiving means carried by each side of said oscillating support means.

6. The automatic packing machine of claim 4 and means for remembering a plurality of types of small items carried by said receiving means whereby different types of small items can be packaged in unique combinations.

7. The automatic packing machine of claim 4 further comprising a product spout means positioned between said receiving means and said carton, said product spout having a number of tracks corresponding to a number of small items in a batch, and means whereby one small item drops from each of said tracks in said product spout into said carton during said excursion.

8. The automatic packaging machine of claim 1 and cleaning means associated with said source means and said loading machine for removing debris from said small items before they reach said transfer position.

9. The automatic packaging machine of claim 8 wherein said cleaning means comprises a first screen for passing debris smaller than said small items while retaining said small and larger items and a second screen for passing said small items while retaining said larger items, and means for transferring small items rejected by said first screen and passed by said second screen to said transfer position.

10. A machine for packaging a few candy coated pieces of chewing gum in a box, said machine comprising means for endlessly conveying a plurality of pocket plates past a product pick up station, each of said plates having a batch size number of said pockets dimensioned to receive a piece of said candy coated chewing gum, said pockets being associated in batches according to the number of said candy coated chewing gum that are contained in a box, means for conveying said plates with said pieces of candy coated chewing gum in said pockets to a transfer position, means at said transfer position for receiving said pieces of chewing gum from said pockets, means for conveying boxes past said transfer position, and means for depositing said pieces of chewing gum from a position in which they are received from said pockets to a position where a batch of said pieces of chewing gum fit into each of said boxes.

11. The machine of claim 10 wherein said depositing means is a twisted funnel.

12. The machine of claim 10 further comprising means for inverting said plates near said transfer position so that said pieces of chewing gum fall out of said pockets and into said depositing means.

13. The machine of claim 10 wherein there are a particular plurality of said number of batch pockets on each of said plates, a particular plurality of said depositing means, each of said depositing means confronting an individually associated one of said batch number of pockets whereby each of said number of pockets and a depositing means comprises a lane for filling one box, a reciprocatingly movable plate mounting said particular plurality of said depositing means, conveyor means for carrying said boxes under said depositing means in synchronism with said reciprocating movement, whereby said candy coated chewing gum falls from said pocket plates and into said boxes during one direction of said reciprocal movement of said depositing means, said reciprocal movement in an opposite direction returning said depositing means to load the next of said boxes.

14. The machine of claim 13 wherein there are many lanes, each lane comprising a pair of said pockets and a depositing means in the form of a twisted funnel.

15. The machine of claim 13 wherein said reciprocatingly movable plate has two sides each of said two sides carrying many of said lanes.

16. The machine of claim 13 wherein each of said lanes can carry a different type of said candy coated chewing gum.

17. An automatic packaging machine comprising a hopper having means for receiving and dispensing product, a pair of screens for sorting said dispensed product by size, said screens selecting acceptable small items, a pocket plate conveyor having a plurality of plates with a batch number of associated pockets, each pocket being shaped and sized to receive one product in each of said pockets whereby a batch of products is received in a batch of pockets, means for urging said products into said pockets and for sweeping away extra products and debris thereof, means for inverting said plates to dump said products out of said pockets at a transfer location, means for orienting each of said dumped batch of products to be arranged in a given direction, conveyor means for moving a continuous stream of containers in said given direction and past said orienting means, said orienting means moving in synchronism with said conveyor means, means for transferring said batch of said oriented products into said container during said synchronized movement, and means for returning said transferring means to a start position for transferring the next batch of products into the next of said containers.

18. The machine of claim 17 wherein there are a plurality of said pairs of pockets and a plurality of said orienting means, each of a plurality of pairs of pockets and an individually associated one of a plurality of orienting means constituting a loading lane, and means comprising said plurality of lanes for simultaneously filling a plurality of said containers.

19. The machine of claim 18 wherein plurality of said orienting means are mounted on an oscillating plate mounted for reciprocating motion.

20. The machine of claim 17 wherein said pocket conveyor and conveyor means are perpendicular to each other and said orienting means turns said products by 90°.

* * * * *